US007642439B2

(12) United States Patent
Fujii

(10) Patent No.: US 7,642,439 B2
(45) Date of Patent: Jan. 5, 2010

(54) ELECTRONIC DRUM AND ITS DRUM HEAD

(75) Inventor: Junji Fujii, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/517,240

(22) Filed: Sep. 7, 2006

(65) Prior Publication Data

US 2007/0051231 A1 Mar. 8, 2007

(30) Foreign Application Priority Data

Sep. 8, 2005 (JP) ..... 2005-260996
Sep. 8, 2005 (JP) ..... 2005-260997

(51) Int. Cl.
*G10D 13/02* (2006.01)

(52) U.S. Cl. ..... 84/411 M; 84/414

(58) Field of Classification Search ..... 84/411 R, 84/414, 411 M, 418, 419, 730–732, 734
See application file for complete search history.

(56) References Cited

U.S. PATENT DOCUMENTS 5,159,139 A * 10/1992 Beals et al. ..... 84/414
5,920,026 A 7/1999 Yoshino et al.
6,121,538 A 9/2000 Yoshino
6,271,458 B1 8/2001 Yoshino
6,525,249 B1 2/2003 Suenaga
6,576,829 B1 6/2003 Hart
6,921,857 B2 * 7/2005 Yoshino et al. ..... 84/738
6,949,701 B2 9/2005 Okumura
7,038,117 B2 5/2006 Yoshino
2004/0083873 A1 5/2004 Yoshino
2005/0150366 A1 * 7/2005 Susami ..... 84/735

FOREIGN PATENT DOCUMENTS

FR 2 682 799 4/1993
JP H01-054095 4/1978
JP H01-054096 3/1979
JP 57-166495 10/1982

(Continued)

OTHER PUBLICATIONS

Extended European Search Report Dated Apr. 4, 2007.

(Continued)

*Primary Examiner*—David S. Warren
(74) *Attorney, Agent, or Firm*—Pillsbury Winthrop Shaw Pittman LLP

(57) ABSTRACT

An electronic drum 30 comprises a hollow body part 10 having an opening side, a drum head stretched over the opening side of the hollow body part 10 and having a stroked surface, an elastic cushion part 40 arranged to touch with a reverse side of the stroked surface of the drum head 30, a vibration absorber 43 that is arranged inside the body part 10 and absorbs a vibration transmitted from the body part 10, and a sensor 41 that is arranged in the vibration absorber 43 to touch with the elastic cushion part 40 and outputs a result of detecting a stroke on the drum head 30 transmitted by the elastic cushion part 40. The drum head 30 is made of a lamination of a plurality of elastic films and has a plurality of holes 30*h* pierced thorough all layers of the laminated films.

6 Claims, 5 Drawing Sheets

FOREIGN PATENT DOCUMENTS

| | | |
|---|---|---|
| JP | 2117569 | 9/1990 |
| JP | 10-020854 | 1/1998 |
| JP | 10020854 | 1/1998 |
| JP | 10-198354 | 7/1998 |
| JP | 11219168 | 8/1999 |
| JP | 2001142459 | 5/2001 |
| JP | 2003-280635 | 10/2003 |
| JP | 2004-198657 | 7/2004 |

OTHER PUBLICATIONS

European Search Report (Partial), "," European Patent Office (The Hague), (Dec. 4, 2006).
Jun. 23, 2009 Office Action, Japanese Patent Application No. 2005-260996.
Japanese Patent Office, Partial Translation of Japanese Office Action dated Oct. 6, 2009 (3 pgs.).
Japanese Patent Office, Notice of Reasons of Rejection for Application No. 2005-260997 (Dated: Jul. 28, 2009; 2 pgs.).

* cited by examiner

ELECTRONIC DRUM AND ITS DRUM HEAD

CROSS REFERENCE TO RELATED APPLICATION

This application is based on Japanese Patent Application 2005-260996, filed on Sep. 8, 2005 and Japanese Patent Application 2005-260997, filed on Sep. 8, 2005, the entire contents of which are incorporated herein by reference.

BACKGROUND OF THE INVENTION

A) Field of the Invention

This invention relates to a percussion instrument such as an electronic drum and a drum head of the percussion instrument.

B) Description of the Related Art

For example, as inventions of an electronic percussion instrument that can obtain the same striking feel as an acoustic drum and restrain a drum beat when stroked, there are inventions disclosed in Japanese Laid-Open Patent Hei 10-20854 (hereinafter called the patent document 1) and Japanese Laid-Open Patent 2001-142459 (hereinafter called the patent document 2). The electric percussion instrument detects a stroke on a drum head and electrically outputs sound corresponding to the detected stroke, for example.

In the electric percussion instrument disclosed in the patent document 1, a piezoelectric device for detecting a stroke on a drum head is adhered to a supporting part positioned inside the electric percussion instrument. A conic-trapezoidal cushion part formed of elastic material such as rubber or sponge is adhered to an upper surface of this piezoelectric device, and a tip of the cushion part contacts with the drum head. Since the cushion part contacts with the drum head, the stroke on the drum head is not directly transmitted to the piezoelectric device even if the drum head is stroked with a stick, and damage of the piezoelectric device can be suppressed.

Moreover, the electronic percussion instrument disclosed in the patent document 1 equips with a drum head formed of a netlike part made of a lamination of a first plain-woven net and a second plain-woven net wherein a weaving direction of each net is slanted to that of the another net as. In the disclosed percussion instrument, when the drum head is stroked with a stick, air passes through openings of a mesh of the netlike parts, and a drum beat produced by striking the drum head will be small.

On the other hand, the electronic percussion instrument disclosed in the patent document 2 equips with a drum dead made of a punching sheet having a large number of opening holes. In the disclosed percussion instrument, when the drum is stroke with a stick, transmission of vibration of the drum head to the air is decreased by the large number of the opening holes, and the drum beat will be small. Also, since rebounding of the stick on the punching sheet is larger than that on the netlike drum head, a striking feel like a normal acoustic drum can be obtained.

When the instrument is shaped by imitating an acoustic drum such as the electric percussion instrument disclosed in the patent document 1, parts other than the drum head may be touched with a stick or by a performer. In the electric percussion instrument disclosed in the patent document 1, the supporting material adhered to the piezoelectric device is fixed to a body of the electric percussion instrument. Therefore, when the stick or a performer touches with a part other than the drum head, the vibration by the touch is directly picked up by the piezoelectric device adhered to the supporting part. When the vibration is transmitted to the piezoelectric device, the piezoelectric device detects the vibration, and a sound corresponding to the touch will be output without striking on the drum head.

Moreover, because the drum head is a nondurable part, it is necessary to also have durability in some extent. In order to improve durability of the drum head in the percussion instrument disclosed in the patent document 1, it is considered that intervals of the plain woven fibers is made to be close. However, when the intervals of the fibers are close, opening parts become narrow, and silencing ability will be degraded. In order to improve durability of the drum head in the electronic musical instrument disclosed in the patent document 2, it is considered that thickness of the punching sheet is made to be thickened. However, when the punching sheet is thickened, tension of the drum head stretched over the body (sound box) becomes high, going down of a tip of the stick to the drum head will be small. Therefore, the striking feel will be the same as that when striking a board and a good striking feel cannot be obtained.

SUMMARY OF THE INVENTION

It is an object of the present invention to provide a drum head that has both durability and silencing ability with a good striking feel.

It is another object of the present invention to provide an electronic drum that does not generate a sound by touching a part other than a drum head.

According to one aspect of the present invention, there is provided a drum head is stretched over an opening side of a hollow drum body, made of a lamination of a plurality of elastic films and having a plurality of holes pierced thorough all layers of the laminated films.

According to the present invention, there is provided a drum head that has both durability and silencing ability with a good striking feel.

According to another aspect of the present invention, there is provided an electronic drum, comprising: a hollow body part having an opening side; a drum head stretched over the opening side of the hollow body part and having a stroked surface; an elastic cushion part arranged to touch with a reverse side of the stroked surface of the drum head; a vibration absorber that is arranged inside the body part and absorbs a vibration transmitted from the body part; and a sensor that is arranged in the vibration absorber to touch with the elastic cushion part and outputs a result of detecting a stroke on the drum head transmitted by the elastic cushion.

According to the present invention, there is provided an electronic drum that does not generate a sound by touching a part other than a drum head.

DETAILED DESCRIPTION OF THE PREFERRED EMBODIMENTS

Figure 1:
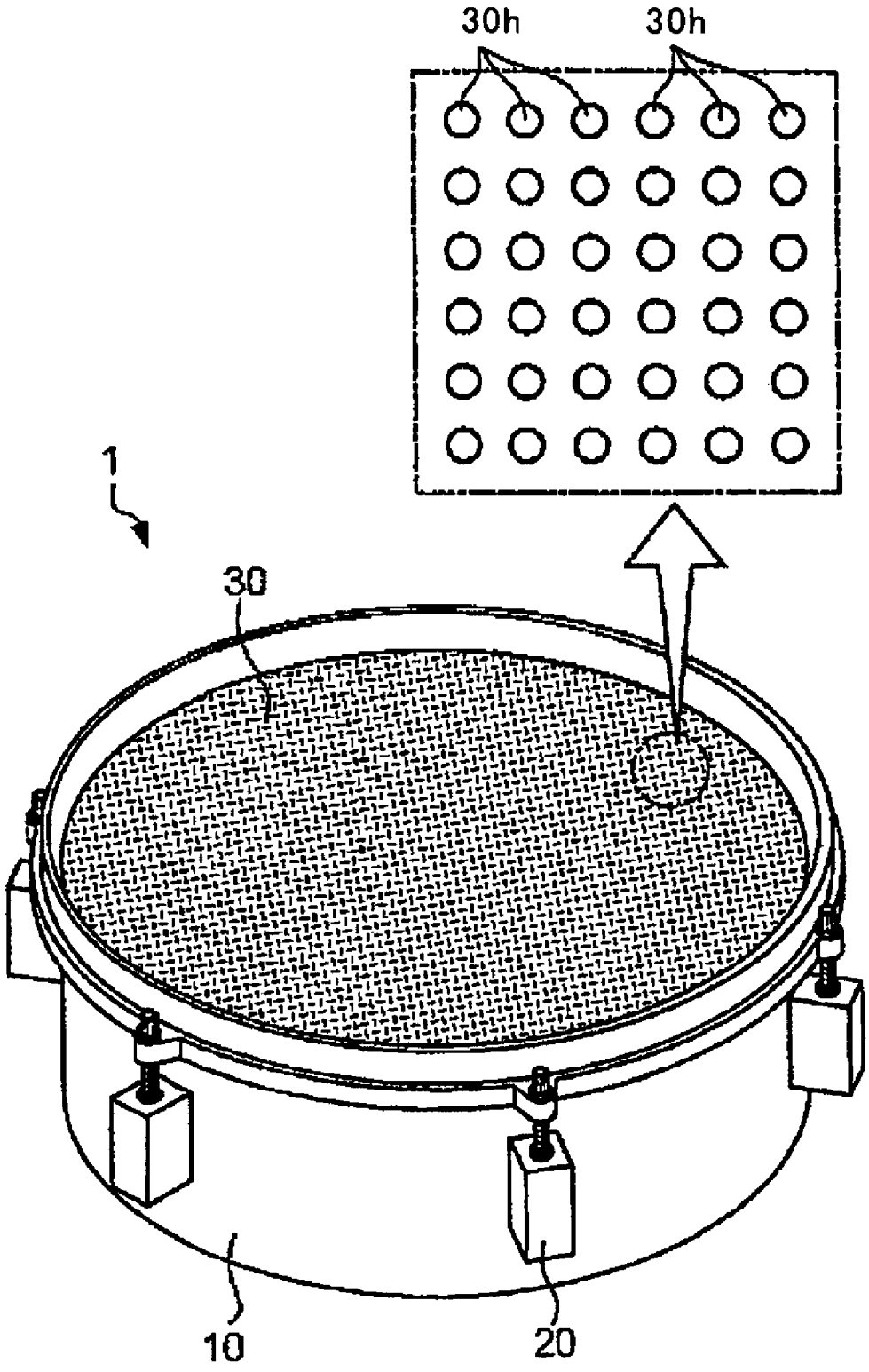
FIG. 1 is a diagram showing an appearance of a percussion instrument according to embodiments of the present invention.
Figure 2:
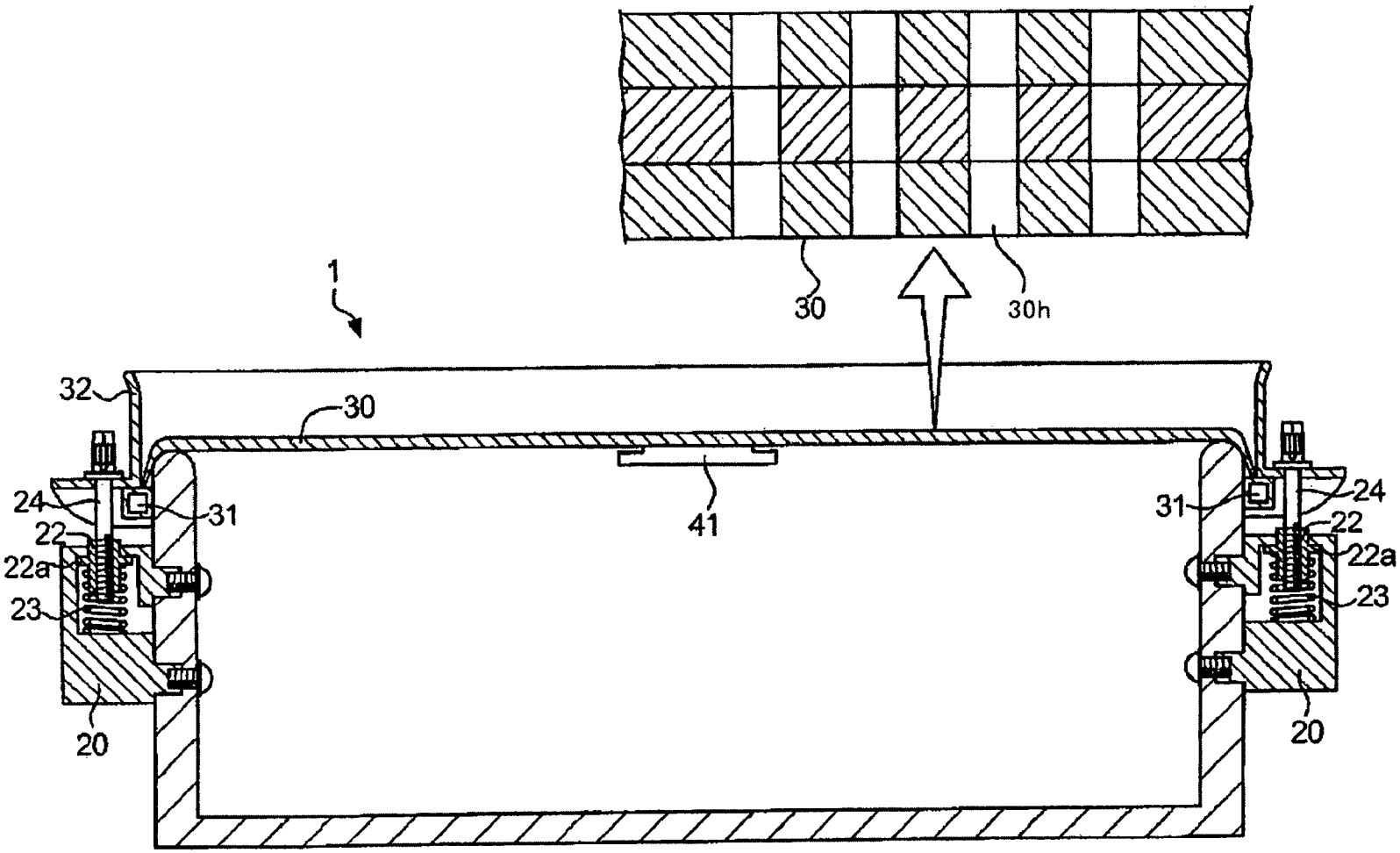
FIG. 2 is a cross sectional view of the percussion instrument according to the first embodiment of the present invention.

A percussion instrument according to a first embodiment of the present invention will be explained with reference to the drawings. FIG. 1 is a diagram showing an appearance of a percussion instrument according to embodiments of the present invention. FIG. 2 is a cross sectional view of the percussion instrument according to the first embodiment of the present invention. As shown in FIG. 1, this percussion instrument 1 equips with a cylindrical body part (sound box) 10 and a drum head 30. Rag cases 20 are fixed with screws at a fixed interval to a direction of circumference of the body part 10 on the peripheral surface of the cylindrical sound box 10. As shown in FIG. 2, each rag nut 22 is exposing one of tips to an outside through a hole formed on the rag case 20, and spring 23 is supporting the rag nut 22 for pushing out to outside. Each of the rag nuts 22 is shaped in a cylindrical shape, and a guard 22*a* for preventing falling out is unitedly formed on the peripheral of each rag nut 22. Moreover, screw holes for screwing a rag bolt 24 into the rug nut 22 is pierced in the center of each rug nut 22.

The periphery of the drum head 30 is supported by a head frame 31. A fastening frame 32 formed in the periphery of the drum head 30 and the rag nuts 22 are connected by the rag bolts 24. When the fastening frame 32 are pressured toward the head frame 31 by fastening the rag bolts 24, tension is added on the drum head 30 so that the drum head 30 is stretched over the opening side of the body part (sound box) 10.

The drum head 30 is made by laminating three layers of polyethylene terephthalate films as shown in an enlarged upper right section in FIG. 2, and the layers of the films are just overlapped with each other. Further, as shown in FIG. 1 and FIG. 2, a large number of piercing holes 30*h* with diameter of 0.5 mm to 3 mm are formed on the drum head 30, and those opening hole ratio (an opening area/an area of whole drum head) is from 20 percent to less than 50 percent. A high processing technique is necessary to open holes with diameter of 0.5 mm or less, and it will take high cost. Therefore, the diameter of the piercing holes 30*h* according to the embodiment of the present invention is 0.5 mm or more. Moreover, when the diameter of the piercing holes 30*h* is 3 mm or more, the stick get into the piercing hole, and the drum head 30 may be broken by stroke of the stick. Therefore, the diameter of the piercing holes 30*h* according to the embodiment of the present invention is 3 mm or less. Moreover, when the opening hole ratio is 20 percent or less, air passing through the piecing holes 30*h* become less when the drum head 30 is stroked by the stick, and vibration transmitted to the air from the drum head 30 will not decrease, and loudness of a drum beat (produced sound) cannot be decreased. Therefore, according to the embodiment of the present invention, the opening hole ratio is 20 percent or more. Moreover, when the opening hole ratio is 50 percent or more, an amount (volume) of the films composing the drum head 30 decreases, and stretching strength of the drum head 30 becomes insufficient. Therefore, the opening hole ratio according to the embodiment of the present invention is less than 50 percent.

A shock (vibration) sensor 41 is stuck on a reverse side of a stroked surface of the drum head 30. The shock sensor is a sensor for detecting shock (stroke or vibration) when the drum head 30 is stroked by a stick and outputs an electric signal corresponding to the detected shock. Moreover, the electric signal output from the shock sensor 41 is input to a musical tone generator (shot shown in the drawing) in the outside of the body part 10 via a signal line (not shown in the drawing). When the electric signal output from the shock sensor 41 is input to the musical tone generator, the musical tone generator outputs a drum beat (sound) based on the input electric signal.

When a performer strikes the drum head 30 having the above-described structure with a stick, the air compressed in the percussion instrument 1 by the stroke comes out from the plurality of piercing holes 30*h* formed on the drum head 30 to the outside of the percussion instrument 1. When the air compressed in the percussion instrument 1, air compressing ratio near the upper and bottom surfaces of the drum head 30 dramatically falls, and transmission of the vibration of the drum head 30 to the air decreases. Therefore, the loudness of the drum beat is lower comparing to a case without a piercing hole.

Moreover, in order to obtain the drum head 30 with the opening hole ratio of 20 percent or more, thickness of the drum head should br thickened for sufficient stretching strength. However, if the drum head 30 is thickened, rigidity of the drum head also becomes high, and it will cause a striking feel to be bad. However, in the embodiment of the present invention, the drum head is composed by laminating the plurality of the films, and each film is not adhered with others. Therefore, a gap (shifting) is generated between films when stroked and deforming amount is larger than a thick single layer. Therefore, even though the drum head is thickened in order to obtain stretching strength, a striking feel will not be bad.

Next, a percussion instrument according to the second embodiment of the present invention will be explained with reference to the drawings. Moreover, in the below-described second embodiment explained, the same parts as in the structure of the first embodiment are added with the same numerals, and the explanations for those parts will be omitted.

Figure 3:
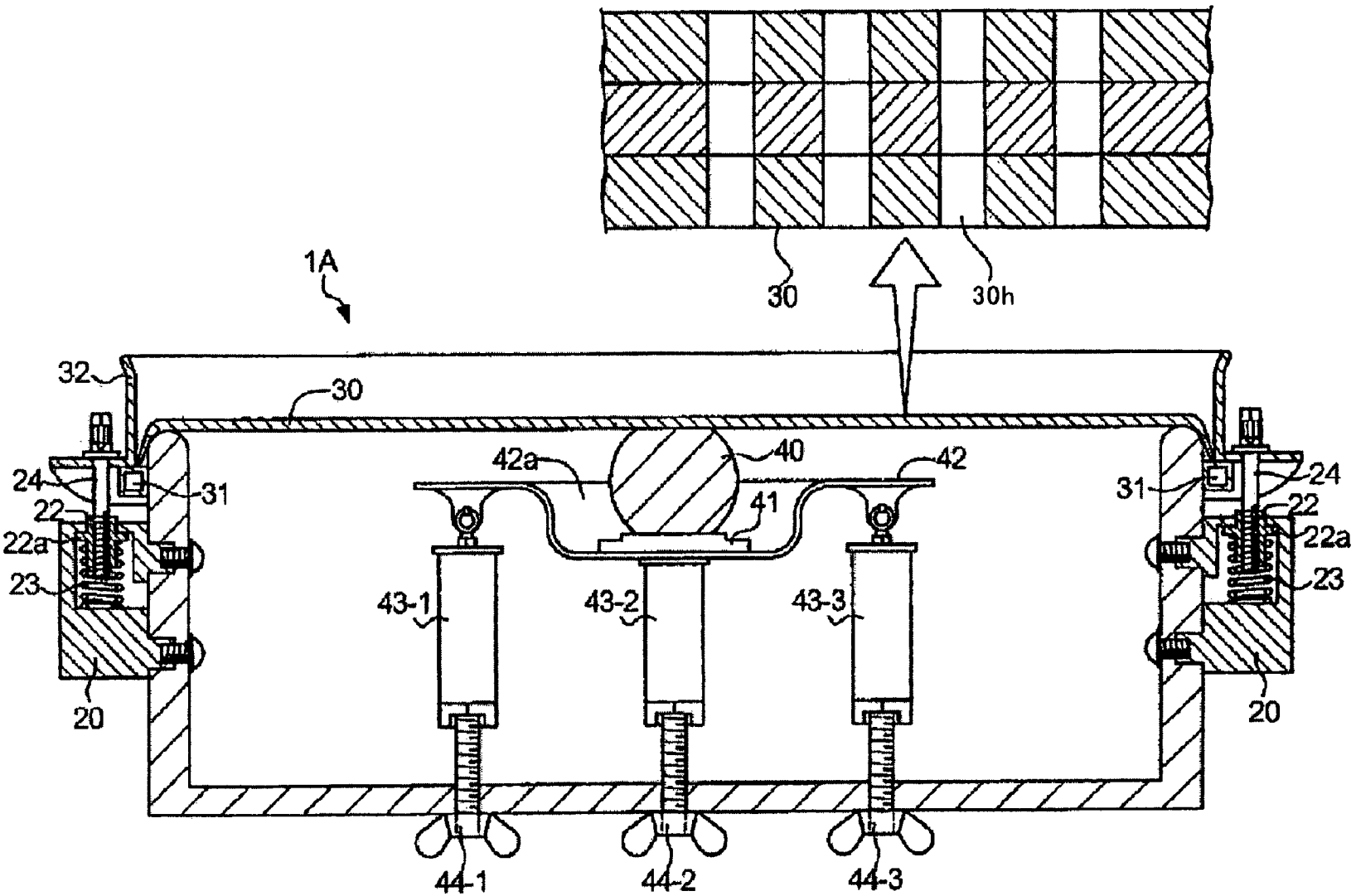
FIG. 3 is a cross sectional view of the percussion instrument according to the second embodiment of the present invention.

As shown in FIG. 3, a percussion instrument 1A according to the second embodiment of the present invention is different from the first embodiment present invention in a structure for detecting shock (vibration) generated by a stroke of a stick. As shown in FIG. 3, the percussion instrument 1A is consisted of a cushion part 40, a shock (vibration) sensor 41, a pedestal part 42, shock (vibration) absorbers 43-1 to 43-3 and adjusting screws 44-1 to 44-3. The pedestal part 42 is equipped with the shock sensor 41 in a concave part 42*a* and supported by the shock absorbers 43-1 to 43-3, and is pressed to a direction of the drum head 30 by the shock absorbers 43-1 to 43-3.

The sphere-shaped or sphere like shaped cushion part 40 that transmits shock (vibration) generated on the drum head 30 is, for example, made of polyurethane and placed between the drum head 30 and the shock sensor 41. Because the cushion part 40 is shaped in a sphere like shape, when the shock given by a stroke with a stick is small, a contacting area of the cushion part 40 and the drum head 30 will be small, and the shock given to the shock sensor 41 will be also small. On the other hand, when the shock given by a stroke with a stick is large, a contacting area of the cushion part 40 and the drum head 30 will be large, and the shock given to the shock sensor 41 will be also large. Shock can be precisely detected corresponding to a magnitude of shock given by a stroke. Even if shock given by a stroke with a stick is large, a contacting area of the cushion part 40 and the drum head 30 becomes large; therefore, vibration of the drum head 30 is absorbed by the cushion part 40 to improve a silencing effect.

The shock sensor 41 is a sensor for detecting shock (vibration) transmitted via the cushion part 40 and outputs an electric signal corresponding to the detected shock.

The shock absorbers 43-1 to 43-3 are equipped with springs and dampers (both are not shown in the drawing)

inside the shock absorbers along a direction of axis. One tips of the shock absorbers 43-1 to 43-3 are stuck to the pedestal part 42, and another tips are stuck to the adjusting screws (wing screws) 44-1 to 44-3 piercing a bottom surface of the body part 10. Moreover, an electric signal output from the shock sensor 41 is input to a musical tone generator (not shown in the drawing) that is outside of the body part 10 via a signal line (not shown in the drawing). When the electric signal output from the shock sensor 41 is input to the musical tone generator, the musical tone generator outputs a drum beat based on the input electric signal.

The adjusting screws 44-1 to 44-3 are screws for adjusting positions of the pedestal part 42. When the adjusting screws 44-1 to 44-3 are screwed, a distance between the bottom of the body part 10 and the shock absorbers 43-1 to 43-3 changes, and the shock absorbers 43-1 to 43-3 change their positions. Corresponding to the movement of the shock absorbers 43-1 to 43-3, the position of the pedestal part 42 changes its position, and pressure that the shock sensor 41 positioned on the pedestal part 42 pushes the cushion part 40 will change. That is, by screwing the adjusting screws 44-1 to 44-3, the pressure that the shock sensor 41 pushes the cushion part 40 is adjusted so that the contacting area of the cushion part 40 and the drum head 30 will be adjusted. When the contacting area is changed, the shock transmitted to the shock sensor 41 will change even though the drum head 30 is stroked with the same power. That is, sensitivity to detect shock is adjusted by screwing the adjusting screws 44-1 to 44-3.

When a performer strikes the drum head 30 of this structure with a stick, only shock transmitted from the drum head 30 via the cushion part 40 will be transmitted to the shock sensor 41. Because the pedestal part 42 equipped with the shock sensor 41 is supported by the shock absorbers 43-1 to 43-3 and does not directly contact with the body part 10. Moreover, since the vibration generated by touching with the body part 10 by the performer and the vibration generated by touching the stick with a part other than the drum head 30 are absorbed by the shock absorbers 43-1 to 43-3, the signal output from the shock sensor 41 represents only the stroke given to the drum head 30 by the stick, and influence of the vibration from outside will be less.

Although the present invention has been explained along with the preferred embodiments, the invention is not limited only to the above embodiments. It is apparent that various modifications, improvements, combinations, and the like can be made by those skilled in the art. For example, the above-described embodiments may be modified as below and may be executed.

In the above-described embodiments, the material of the drum head 30 is polyethylene terephthalate; however, it is not limited to that. For example, it may be polyimide, polyethylene naphthalate and other material. Moreover, the films may be laminated with more than three layers for the drum head 30, or it may be two layers other than three layers. Moreover, thickness of the laminating films may be changed corresponding to the material of the films. The thickness of the films composing the drum head 30 may be changed by every laminating layer. In the above-described embodiments, the diameter of the piercing hole 30*h* formed on the drum head 30 is 0.5 mm to 3 mm; however, it may be 3 mm or more when the film material composing the drum head is strong enough. Moreover, each layer of the drum head may be adhered to others by using a weak adhesive.

Figure 4:
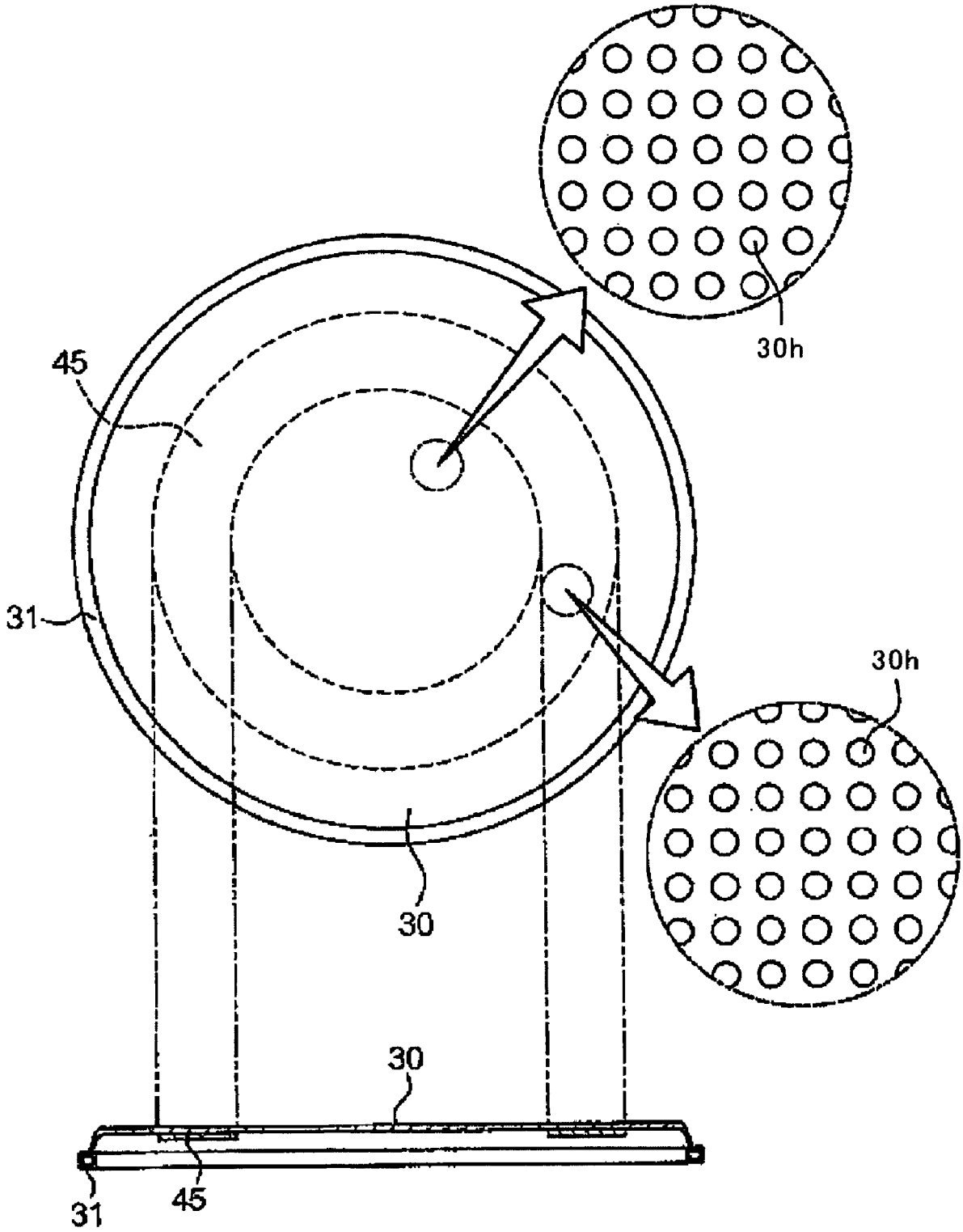
FIG. 4 is a diagram for explaining a drum head according to a modified embodiment of the present invention.

Further, as shown in FIG. 4, a donut-shaped (ring-shaped) film 45 may be adhered to the reverse side of the surface of the drum head 30 according to the above-described embodiments, and piercing holes piercing this film and the drum head 30 may be opened. Moreover, the donut-shaped film that is adhered to the drum head 30 may be formed of a lamination of a plurality of films other than the single layer. Moreover, density (the number of the piercing holes per unit area) of the piercing holes in the center part of the drum head may be sparse, and density of the piercing holes in an outer rim (periphery) of the drum head 30 may be dense. According to these structures, a high-level vibration mode having many vibration loops in the outer rim of the drum head 30 decreases, and the vibration around the drum head 30 is suppressed so as to increase silencing ability in high frequencies. Moreover, the diameter of the piercing holes 30*h* in the center part of the drum head and the diameter of the piercing holes 30*h* in the outer rim part (periphery) of the drum head 30 may be different.

Figure 5:
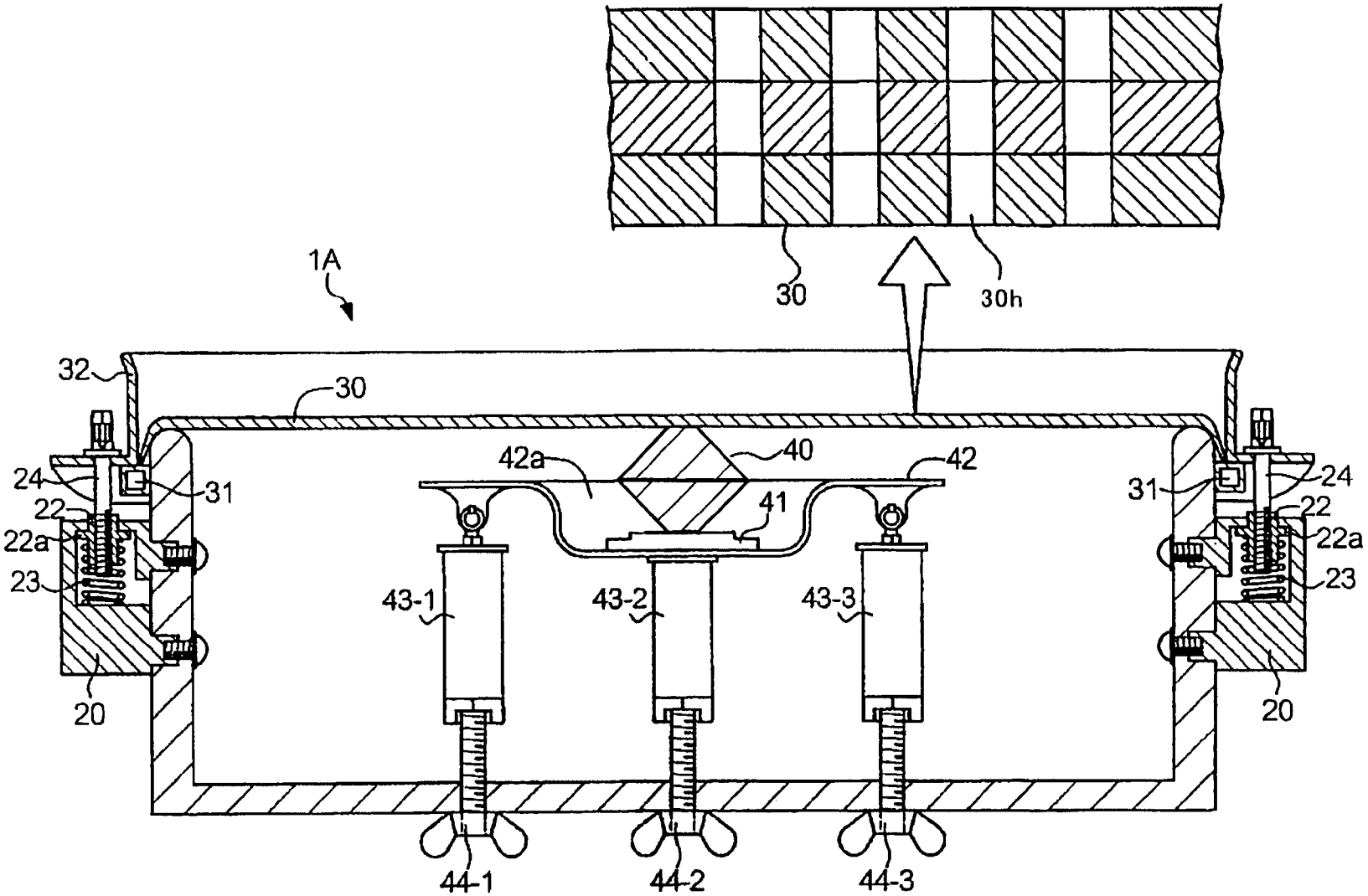
FIG. 5 is a cross sectional view of the percussion instrument according to another embodiment of the present invention.

In the above-described second embodiment, the shape of the cushion part 40 is a sphere or a mostly sphere; however, it is not limited to that. For example, as shown in FIG. 5, bottoms of two cushion parts of circular cones (or cushion parts shaped in a polygonal pyramid such as a triangular pyramid and a rectangular pyramid) may be stuck for using them as the cushion part 40. In this case, the cushion parts are placed between the drum head 30 and the shock sensor 41 in order to a one top of the stuck circular cone (polygonal pyramid) contacts with the drum head 30 and another top of the circular cone (polygonal pyramid) contacts with the shock sensor 41. Moreover, in the above-described second embodiment, the cushion part 40 is placed between the drum head 30 and the shock sensor 41; however, the cushion part 40 may be adhered to the drum head 30, and the cushion part 40 may be pushed with the shock sensor 41 to place the cushion part 40 between the drum head 30 and the shock sensor 41.

In the above-described second embodiment, the shock absorbers 43-1 to 43-3 are equipped with the springs and dampers inside the absorbers; however, the structure not to transmit vibration and shock from the body part 10 to the shock sensor 41 is not limited to that. For example, only the spring may be used for absorbing vibration and shock from the body part 10, and an elastic material other than a spring may be used for absorbing the vibration and the shock. The number of the shock absorbers is not limited to three but may be four or more. The shock absorbers may be equipped in any numbers anywhere unless the shock absorbers can be stably supported by the pedestal part.

Although in the embodiments of the present invention, the drum head is made of laminating the plurality of the films, the drum head may be a single film. Moreover, the piercing holes 30*h* may not be formed on the drum head 30.

Moreover, the structure for detecting stroke on the drum head is not limited to the above-described structure. Further, vibration of the drum head 30 may be detected by the vibration sensor, and the beat sound may be output from the musical tone generator based on the detected vibration.

What is claimed is:

1. A drum head stretched over an opening side of a hollow drum body, the drum head made of a lamination of a plurality of elastic films and having a plurality of holes pierced through all layers of the laminated films, wherein the density of holes per unit area is greater than zero over the entire surface of the drum head, and wherein a density of the pierced holes in a center of the opening is less than the density of the pierced holes in a rim of the opening.

2. The drum head according to claim 1, wherein a shape of a film at a bottom of the laminated films is a ring while a shape of each film other than the film at the bottom is a disc.

3. An electronic drum, comprising:

a hollow body part having an opening side;

a drum head stretched over the opening side of the hollow body part and having a stroked surface;

an elastic cushion part arranged to touch with a reverse side of the stroked surface of the drum head, wherein a contacted area between the elastic cushion part and the drum head is changed by transformation of the elastic cushion part in accordance with strength of a stroke to the drum head;

a vibration absorber that is arranged inside the body part and absorbs a vibration transmitted from the body part; and a sensor that is arranged in the vibration absorber to touch with the elastic cushion part and outputs a result of detecting a stroke on the drum head transmitted by the elastic cushion, wherein the elastic cushion part is composed of a combination of cones or multi-angular pyramids, having bases faced to each other, and placed between the drum head and the sensor, one apex of the cones or the multi-angular pyramids touching the drum head and another apex touching the sensor.

4. The electronic drum according to claim 3, wherein a shape of the elastic cushion part is a sphere.

5. The electronic drum according to claim 3, wherein the drum head is made of a lamination of a plurality of elastic films and has a plurality of holes pierced through all layers of the laminated films.

6. A drum head stretched over an opening side of a hollow drum body, the drum head made of a lamination of a plurality of elastic films each of which is not adhered to each other and having a plurality of holes pierced through all layers of the laminated films, wherein the density of holes per unit area is greater than zero over the entire surface of the drum head, and wherein a density of the pierced holes in a center of the opening is less than the density of the pierced holes in a rim of the opening.

* * * * *